US011065175B2

(12) United States Patent
Ishikawa et al.

(10) Patent No.: US 11,065,175 B2
(45) Date of Patent: Jul. 20, 2021

(54) LEG MASSAGER

(71) Applicant: DAITO ELECTRIC MACHINE INDUSTRY COMPANY LIMITED, Higashi-Osaka (JP)

(72) Inventors: Tetsuya Ishikawa, Higashi-Osaka (JP); Shinsaku Shimizu, Higashi-Osaka (JP)

(73) Assignee: DAITO ELECTRIC MACHINE INDUSTRY COMPANY LIMITED, Osaka (JP)

( * ) Notice: Subject to any disclaimer, the term of this patent is extended or adjusted under 35 U.S.C. 154(b) by 352 days.

(21) Appl. No.: 16/313,307

(22) PCT Filed: Sep. 28, 2018

(86) PCT No.: PCT/JP2018/036327
§ 371 (c)(1),
(2) Date: Dec. 26, 2018

(87) PCT Pub. No.: WO2020/044572
PCT Pub. Date: Mar. 5, 2020

(65) Prior Publication Data

US 2020/0121548 A1 Apr. 23, 2020

(30) Foreign Application Priority Data

Aug. 29, 2018 (JP) ..... JP2018-160363

(51) Int. Cl.
*A61H 15/00* (2006.01)

(52) U.S. Cl.
CPC . *A61H 15/0078* (2013.01); *A61H 2015/0014* (2013.01); *A61H 2201/0192* (2013.01);
(Continued)

(58) Field of Classification Search
CPC ..... A61H 15/0078; A61H 2015/0014; A61H 2201/0192; A61H 2201/12; A61H 2201/1418; A61H 2201/1671
See application file for complete search history.

(56) References Cited

U.S. PATENT DOCUMENTS 6,837,831 B2 * 1/2005 Lee ..... A61H 1/0214 482/57
7,654,971 B2 * 2/2010 Yu ..... A61H 15/00 601/99

(Continued)

FOREIGN PATENT DOCUMENTS

CN 1301704 C 2/2007
CN 102379800 A 3/2012

(Continued)

*Primary Examiner* — Steven O Douglas
(74) *Attorney, Agent, or Firm* — Birch, Stewart, Kolasch & Birch, LLP

(57) ABSTRACT

There is provided a leg massager that massages a user's leg by a position-adjustable massaging system for selectively massaging massage target areas of the leg. The leg massager includes: a lower massaging system that massages a massage target area of the user's leg L including at least user's foot F; an upper massaging system that massages an upper massage target area located above the massage target area which is massaged by the lower massaging system; a driving mechanism that drives the upper massaging system and the lower massaging system; and a rockably supporting portion that supports the upper massaging system for rocking motion about its horizontal axis.

9 Claims, 9 Drawing Sheets

(52) U.S. Cl.
CPC .. *A61H 2201/12* (2013.01); *A61H 2201/1418* (2013.01); *A61H 2201/1671* (2013.01); *A61H 2205/106* (2013.01); *A61H 2205/12* (2013.01)

(56) References Cited

U.S. PATENT DOCUMENTS

| | | | | |
|---|---|---|---|---|
| 8,696,606 | B2 * | 4/2014 | Jacofsky | A61H 15/0078 601/29 |
| 2004/0243029 | A1 | 12/2004 | Shimizu | |
| 2012/0095375 | A1 * | 4/2012 | Ishiguro | A61H 7/007 601/112 |
| 2018/0133095 | A1 | 5/2018 | Ishikawa et al. | |

FOREIGN PATENT DOCUMENTS

| | | | |
|---|---|---|---|
| CN | 107789171 | A | 3/2018 |
| JP | 2001-190622 | A | 7/2001 |
| JP | 2011-103988 | A | 6/2011 |
| JP | 2012-135565 | A | 7/2012 |
| JP | 2017-118930 | A | 7/2017 |
| JP | 2017-153734 | A | 9/2017 |
| TW | 201731478 | A | 9/2017 |
| TW | 201825069 | A | 7/2018 |

* cited by examiner

LEG MASSAGER

TECHNICAL FIELD

The present invention relates to a leg massager that performs pressing massage operation for user's leg, especially a calf-to-thigh range of user's leg, and also user's foot.

BACKGROUND ART

There is a heretofore known leg massager incorporating a massaging system for performing massage on massage target areas of user's leg ranging from a toe-to-heel region, i.e. the foot, to the calf located between the ankle and the knee (refer to Patent Literature 1, for example).

PRIOR ART REFERENCE

Citation List

Patent Literature 1: Japanese Unexamined Patent Publication JP-A 2011-103988

SUMMARY OF INVENTION

Technical Problem

However, the variety of user's demands for equipment capable of massaging treatment has increased in recent years. For example, there is a request asking the incorporation of a system that enables a user to have leg massage, and more specifically massage on leg areas ranging from the foot, through the calf, to the thigh, while sitting in a chair, etc. There is also a request asking a leg massager which is an easy-to-store downsized massaging apparatus and yet has an additional thigh-massaging capability.

The present invention has been devised in view of the circumstances as discussed supra, and accordingly its object is to provide a leg massager capable of massaging any of massage target areas of the leg, including the foot, the calf, and the thigh, of a user sitting in a chair, etc., by using a position-adjustable massaging system to perform massage operation for massage target areas of user's leg.

Solution to Problem

In order to accomplish the described object, the following technical means is adopted for the implementation of the present invention.

The present invention provides a leg massager comprising: a lower massaging system that massages a massage target area of user's leg including at least user's foot; an upper massaging system that massages an upper massage target area located above the massage target area which is massaged by the lower massaging system; a driving mechanism that drives the upper massaging system and the lower massaging system; and a rockably supporting portion that supports the upper massaging system for rocking motion about a horizontal axis of the upper massaging system.

In the present invention, it is preferable that the upper massaging system is mounted within an elongated upper-casing, and the lower massaging system is mounted within a lower casing, and that the rockably supporting portion, which is located toward a top of the lower casing, supports a base end of the upper casing for free rocking motion to impart rising movement to a front end of the upper casing via a horizontally oriented rock shaft.

In the present invention, it is preferable that the upper massaging system has a first massaging member in elongated plate form that performs massage operation for the massage target area, and that, when the upper casing is tilted forwardly to adjacent the lower casing, then the first massaging member housed within the upper casing faces frontward, and, when the upper casing is raised away from the lower casing, then the first massaging member housed within the upper casing faces upward.

In the present invention, it is preferable that the driving mechanism drives the upper massaging system and the lower massaging system together.

In the present invention, it is preferable that the driving mechanism comprises: a driving motor that produces output of a rotatably driving force; an upper transmission shaft that inputs the rotatably driving force outputted from the driving motor to the upper massaging system; and a lower transmission shaft that inputs the rotatably driving force to the lower massaging system, and that the upper massaging system is driven under the rotatably driving force transmitted thereto through the upper transmission shaft, and the lower massaging system is driven under the rotatably driving force transmitted thereto through the lower transmission shaft.

In the present invention, it is preferable that the upper massaging system comprises: a horizontally oriented first rotation shaft which rotates under a rotatably driving force from the upper transmission shaft; a pair of right-hand and left-hand first massaging members located at an intermediate part of the first rotation shaft, the first massaging members being movable close to and away from each other under a rotatably driving force exerted by the first rotation shaft for squeezably holding the upper massage target area; and a first conversion section that converts the rotatably driving force of the first rotation shaft into mutually approaching and separating movement of the paired right-hand and left-hand first massaging members.

In the present invention, it is preferable that the lower massaging system comprises: a horizontally oriented second rotation shaft which rotates under a rotatably driving force from the lower transmission shaft; a pair of right-hand and left-hand second massaging members located at an intermediate part of the second rotation shaft, the second massaging members being movable close to and away from each other under a rotatably driving force exerted by the second rotation shaft for squeezably holding the massage target area including at least the foot; and a second conversion section that converts the rotatably driving force of the second rotation shaft into rocking motion of the paired right-hand and left-hand second massaging members.

In the present invention, it is preferable that the rock shaft and the first rotation shaft are implemented by using one common shaft member.

In the present invention, it is preferable that the upper massaging system has a pitch adjustment mechanism capable of changing a distance between the paired first massaging members by moving at least one of the paired first massaging members in a horizontal direction.

In the present invention, it is preferable that the lower massaging system has a pitch adjustment mechanism capable of changing a distance between the paired second massaging members by moving at least one of the paired second massaging members in a horizontal direction.

Advantageous Effects of Invention

The present invention provides a leg massager capable of massaging any of massage target areas of the leg, including the foot, the calf, and the thigh, of a user sitting in, for example, a chair by using a position-adjustable massaging system to perform massage operation for massage target areas of user's leg.

DESCRIPTION OF EMBODIMENTS

The following describes an embodiment of a leg massager 1 pursuant to the present invention with reference to FIGS. 1 to 9. The following embodiment is given by way of example of carrying out the present invention in practice, and it is thus not intended to be limiting of the structural features of the present invention. Moreover, part of constituent components is omitted from FIGS. 1 to 9 for clarity of illustration.

The leg massager 1 according to the embodiment is capable of massaging different areas (massage target areas) of user's leg L by virtue of its massaging position-adjustable feature.

As employed in this embodiment, the leg L refers to a range extending from thigh T, through calf C, to foot F. More specifically, in this specification, that part of human leg L located above the knee is defined as "thigh T", that part of the leg L located below the knee and yet located above the ankle is defined as "calf C", and that part of the leg L located below the ankle and extending from the heel to the toe is defined as "foot F".

Moreover, such terms of orientation and disposition as shown in some drawings conform with directions (frontward (forward), rearward (backward), rightward, leftward, upward, and downward directions) with respect to a user sitting in a chair, etc. with his/her legs L received in the leg massager 1. In the following description, "calf C" may be also referred to as "first massage target area", and "thigh T" may be also referred to as "second massage target area".

Figure 7:
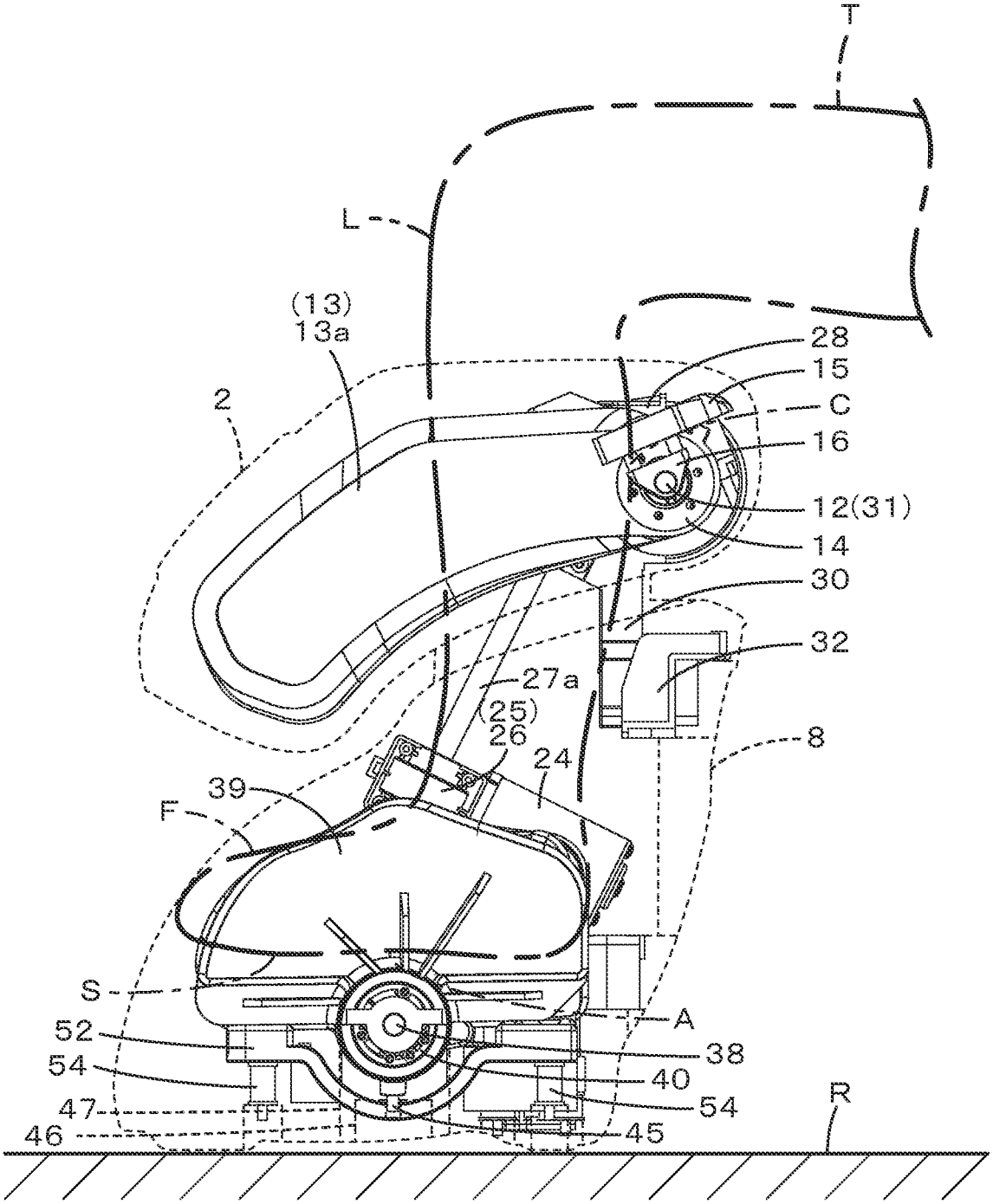
FIG. 7 is a side view showing the leg massager, with the massaging member of the upper massaging system oriented substantially horizontally (in the first position corresponding to user's calf).

Moreover, as a massaging position, for example, as shown in FIG. 7, a position where a first massaging member 13 is oriented substantially horizontally in corresponding relation to the calf C is defined as "first position".

Figure 8:
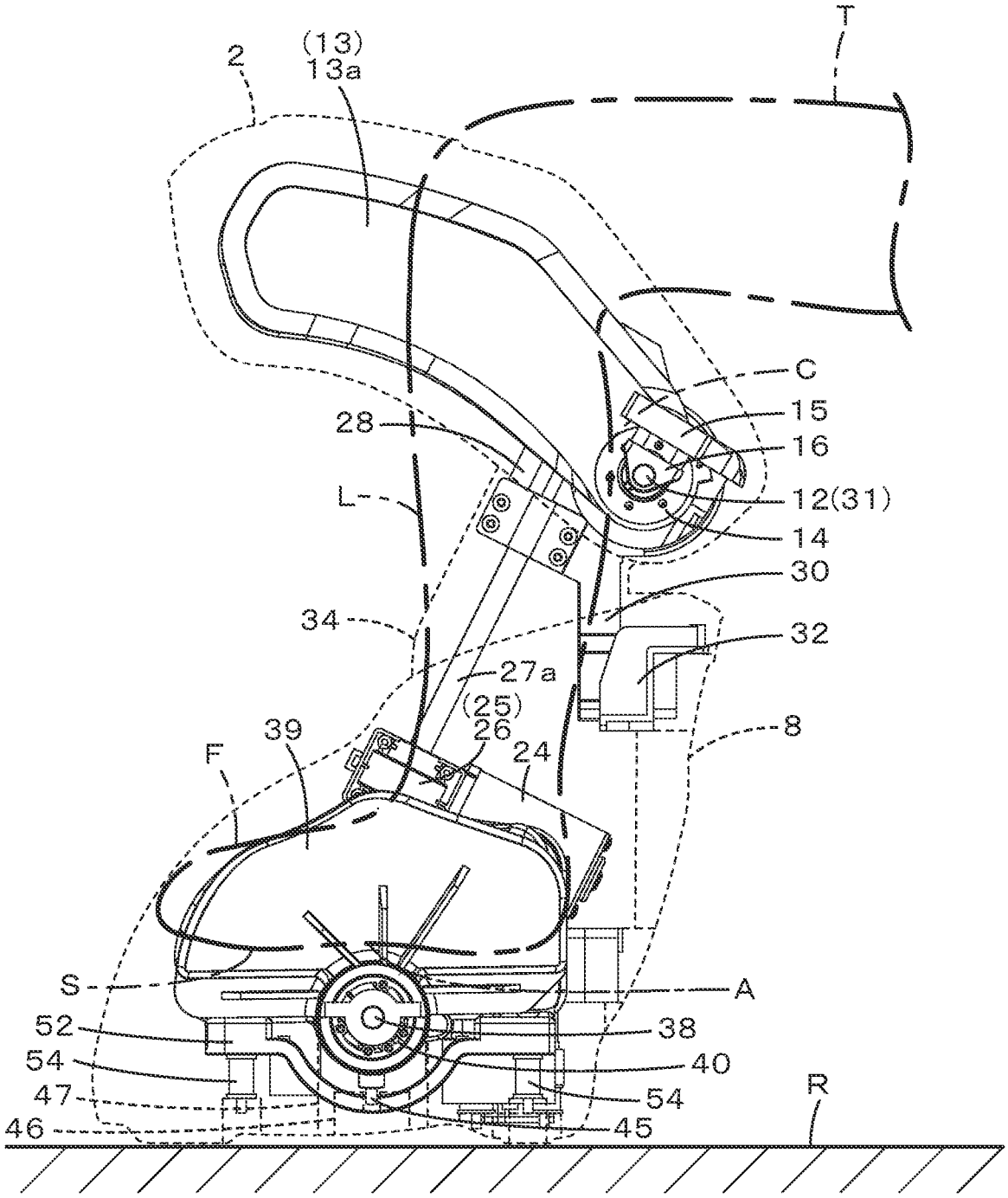
FIG. 8 is a side view showing the leg massager, with the massaging member of the upper massaging system facing frontward obliquely upwardly (the second position corresponding to an upper part of user's calf, user's knee, etc.).

As another massaging position, as shown in FIG. 8, a position where the first massaging member 13 faces frontward obliquely upwardly in corresponding relation to an upper part of the calf C, the knee, etc. is defined as "second position".

Figure 9:
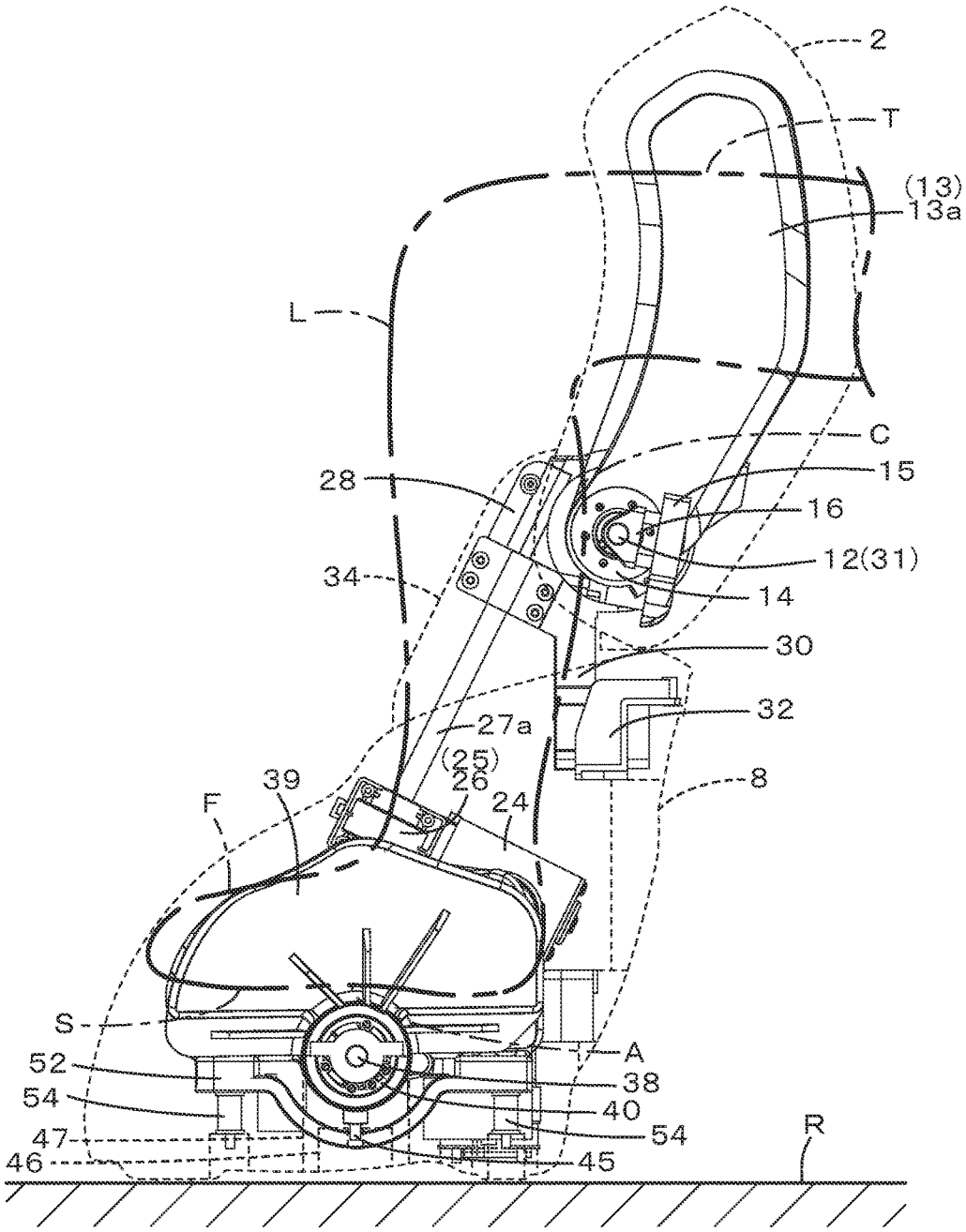
FIG. 9 is a side view showing the leg massager, with the massaging member of the upper massaging system slightly tilted backwardly from the vertical (in the third position corresponding to user's thigh).

As still another massaging position, as shown in FIG. 9, a position where the first massaging member 13 is slightly tilted backwardly from the vertical in corresponding relation to the thigh T is defined as "third position".

The leg massager 1 according to the embodiment is placed on a floor R, for example, for use in massaging both of the right and left legs L of a user sitting in a chair, etc. as massage target areas. The leg massager 1 is designed to effect two kneading massage operations at a time, namely squeezing massage for the foot F belonging to the leg L, and squeezing massage for any of the calf C, the thigh T, and nearby area. The leg massager 1 is also capable of performing finger-pressure massage on user's sole S by producing vibrating and pressing motion.

The leg massager 1 according to the embodiment comprises: an upper massaging system 11 that performs massage operation for any of the calf C, the thigh T, etc. of each of user's right and left legs by actuating a massaging member; a lower massaging system 37 that performs massage operation for each of user's right and left feet F; and a driving mechanism 23 that drives the upper massaging system 11 and the lower massaging system 37.

The upper massaging system 11 is mounted within an upper casing 2. The lower massaging system 37 is mounted within a lower casing 8. Moreover, the driving mechanism 23 is disposed so as to span the upper casing 2 and the lower casing 8.

In the first position, the upper casing 2 has the form of a forwardly elongated member with a bend. The upper casing 2 forms a space therein to accommodate constituent components such as the upper massaging system 11 and a first gear box 28 constituting the driving mechanism 23 to be hereafter described in detail.

The upper casing 2 is capable of back-and-forth rocking motion relative to the lower casing 8 under the support of a rockably supporting portion 30 to be hereafter described in detail. That is, the upper casing 2 is rockable in sync with the rocking motion of the built-in upper massaging system 11 about its horizontal axis.

The upper casing 2 comprises: an open-topped lower cover body 3 mounted with the upper massaging system 11 and a base 15 constituting the upper massaging system 11; and an upper cover body 4 disposed so as to cover the lower cover body 3 from above.

The lower cover body 3 has an open-topped, recess-like form to receive constituent components such as the upper massaging system 11. Moreover, the lower cover body 3 is a forked member having its opposite ends and centrally located part in a right to left, or horizontal direction extended forwardly as furcations. The lower cover body 3 is internally provided with amounting portion 5 for the placement of the base 15 constituting the upper massaging system 11.

Moreover, the lower side of the lower cover body 3 is formed with a centrally located cavity 6 to receive a cap body 34 which covers the rockably supporting portion 30 when the "first position" is attained as the massaging position.

The upper cover body 4 is an open-bottomed member that covers the lower cover body 3 from above. Like the lower cover body 3, the upper cover body 4 is a forked member having its opposite ends and centrally located part in the horizontal direction extended forwardly as furcations.

The centrally located part of the upper cover body 4 in the horizontal direction has its front end extended while being inclined obliquely downwardly in the frontward direction. This inclined part is provided with a switch 60 to allow selection between an actuation mode and a stop mode for the operation of the leg massager 1. Even when the massaging member of the upper massaging system 11 is in the first position (where it is oriented substantially horizontally) as shown in FIG. 7, the switch 60 situated at such an inclined face is discernible with user's eye without fail. Likewise, even when the massaging member is in the second position in corresponding relation to an upper part of the calf, the knee, etc. as shown in FIG. 8, and, even when the massaging member is in the third position in corresponding relation to the thigh as shown in FIG. 9, the position and status of the switch 60 can be identified by the user without fail. It is highly desirable to provide the switch 60 in such a position or place as is discernible with user's eye under all conditions.

In the upper casing 2 in the form of a forwardly extending member with a bend, there is provided a pair of horizontally-spaced-apart first massaging recesses 7 for receiving any of the calf C, the thigh T, etc. of each of user's right and left legs.

For example, in the first position shown in FIG. 7, the first massaging recess 7 opens into the upward surface, the forward surface, and the downward surface of the upper casing 2. The paired right-hand and left-hand first massaging recesses 7 are each internally provided with a lining material, not shown, which is elastic, flexible, and adequately breathable.

The upper cover body 4 and the lower cover body 3 are butt-joined in a top to bottom, or vertical direction to form the upper casing 2. The constituent components such as the upper massaging system 11 are housed in the internal space of the upper casing 2.

Moreover, massaging-position changing can be done by imparting back-and-forth rocking motion to the upper massaging system 11, while grasping both sides of the upper casing 2 in the horizontal direction, so that the upper massaging system 11 can be moved all the way to a desired different position. That is, for example, in the "first position" shown in FIGS. 1 and 7, the right and left calves C are received in the right-hand and left-hand first massaging recesses 7, respectively. In the "second position" shown in FIG. 8, each of the right and left calves C and nearby area such as the knee is received therein. In the "third position" shown in some drawings such as FIGS. 5 and 9, each of the right and left thighs T is received therein.

The lower casing 8 has a domical (convex) form with its upper face curved upwardly. The lower casing 8 forms a space therein to accommodate constituent components such as the lower massaging system 37 and the driving mechanism 23 to be hereafter described in detail. The lower casing 8 is internally provided with a holder portion 32 for the placement of the rockably supporting portion 30.

The upper face of the lower casing 8 is formed with a pair of horizontally-spaced-apart second massaging recesses 9 for receiving user's right and left feet F. The paired right-hand and left-hand second massaging recesses 9 are each internally provided with a lining material, not shown, which is elastic, flexible, and adequately breathable.

Moreover, a hand well 10 is formed at each side of the lower casing 8 in the horizontal direction. The hand well 10 receives user's hand for easy carrying of the leg massager 1.

The following describes the upper massaging system 11 mounted within the upper casing 2.

As shown in FIGS. 1 to 9, in this embodiment, the upper massaging system 11 comprises: a horizontally oriented first rotation shaft 12 which rotates under a rotatably driving force from an upper transmission shaft 27*a* constituting the driving mechanism 23 to be hereafter described in detail; a pair of right-hand and left-hand first massaging members 13 located at an intermediate part of the first rotation shaft 12, the first massaging members 13 being movable close to and away from each other under a rotatably driving force exerted by the first rotation shaft 12 for squeezably holding an upper massage target area such as the calf C or the thigh T; and a first conversion section 14 that converts the rotatably driving force of the first rotation shaft 12 into mutually approaching and separating movement of the paired right-hand and left-hand first massaging members 13.

The upper massaging system 11 is disposed on the base 15 mounted in suspended fashion above the lower casing 8. Via the base 15, the upper massaging system 11 is attached to the upper casing 2.

Each end of the base 15 in the horizontal direction is provided with a shaft supporting portion 16 having a horizontal axis. A shaft bearing (bearing) engages in the shaft supporting portion 16.

The shaft supporting portion 16 rotatably supports each end of the first rotation shaft 12 via the bearing. Moreover, the base 15 is rockably supported by the rockably supporting portion 30 to be hereafter described in detail.

The first massaging member 13 is a member attached to the base 15. There is provided a pair of horizontally-spaced-apart first massaging members 13 capable of squeezably holding a massage target area such as the calf C or the thigh T. The first massaging members 13 perform squeezing (pressing) massage operation for the calf C or the thigh T. The first massaging member 13 is shaped in an elongated plate bent at a lengthwise intermediate point thereof.

Figure 1:
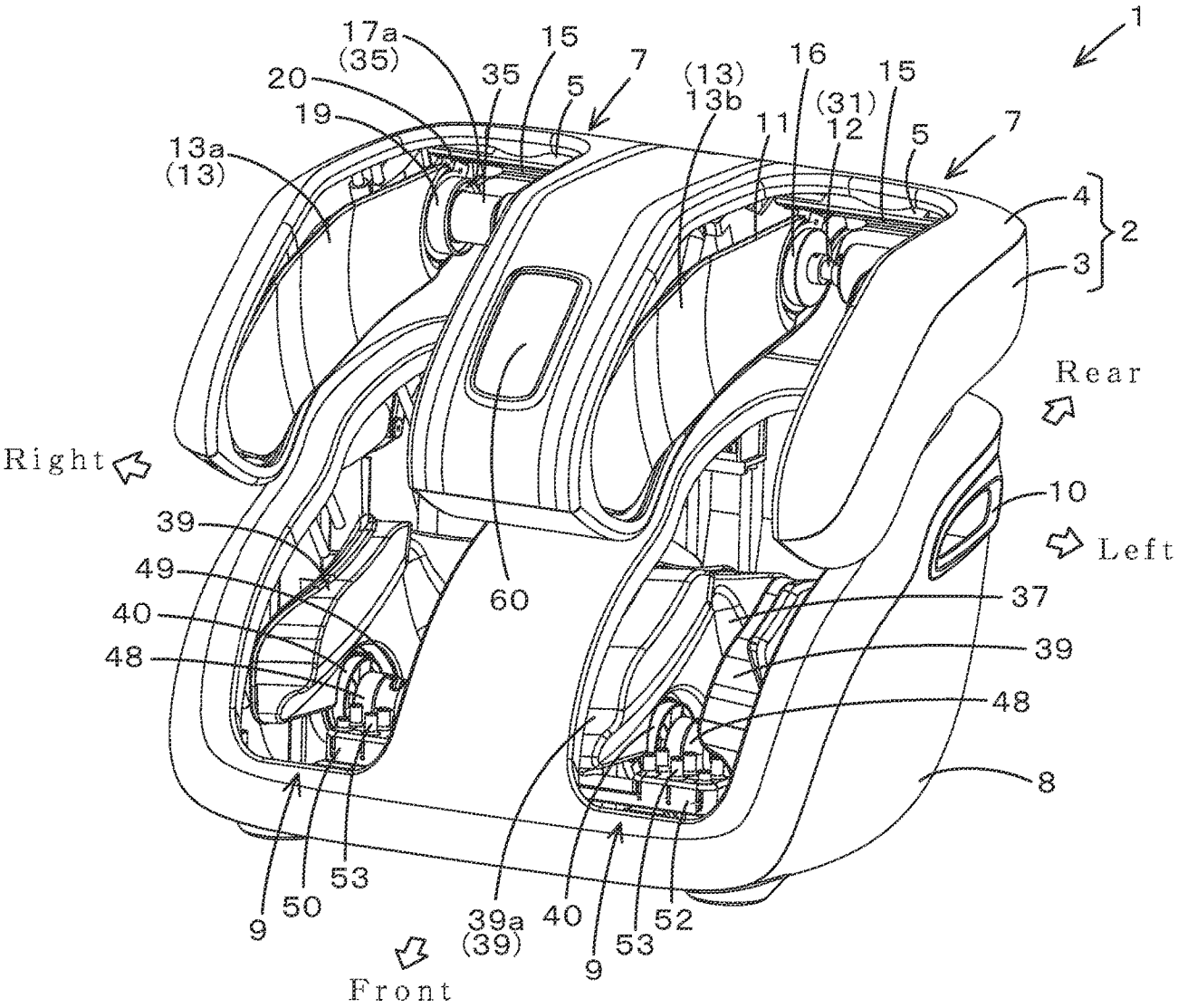
FIG. 1 is a front perspective view showing the structure of a leg massager pursuant to the present invention, with a massaging member of its upper massaging system oriented substantially horizontally (in the first position corresponding to user's calf).
Figure 2:
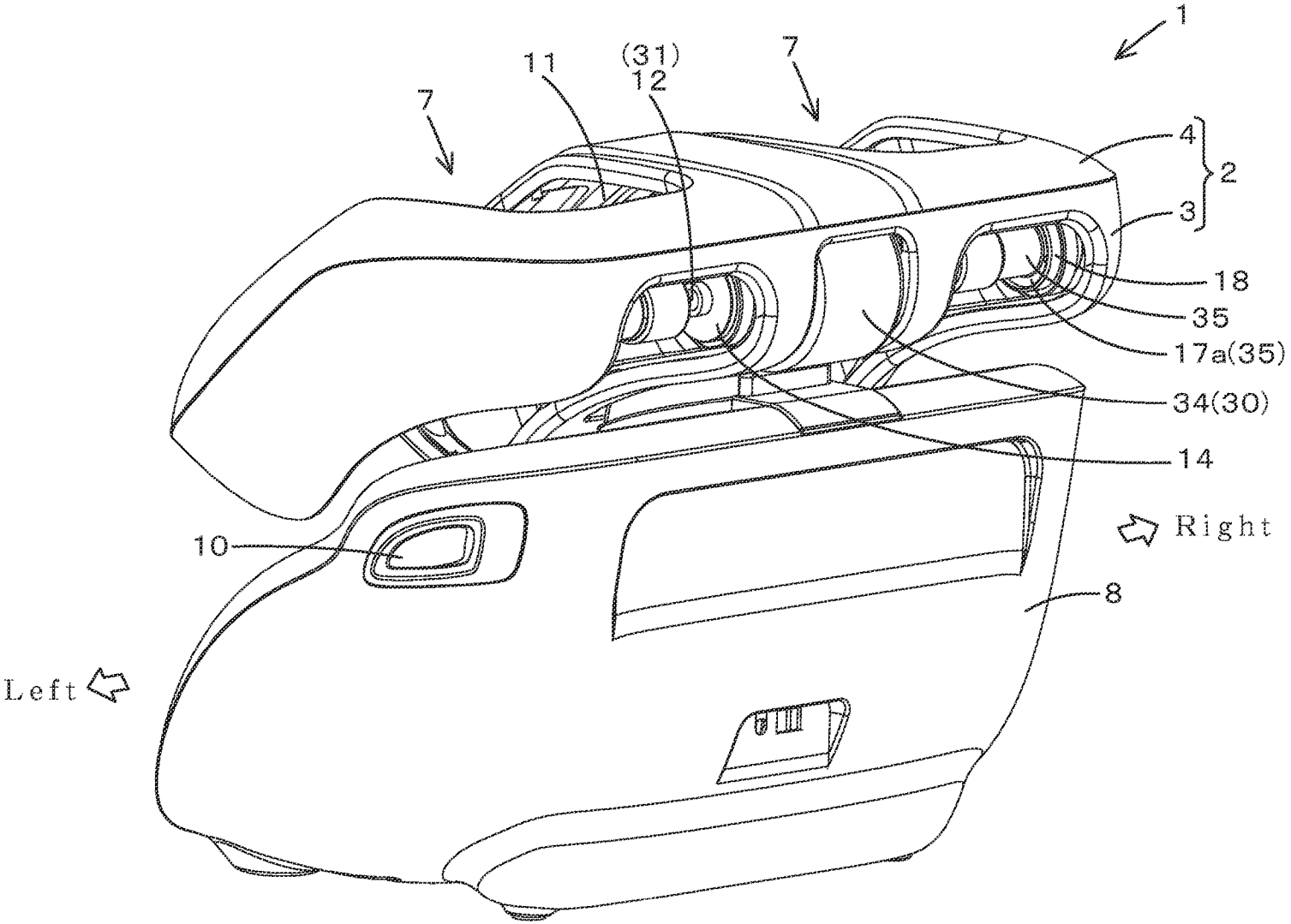
FIG. 2 is a rear perspective view showing the structure of the leg massager embodying the present invention, with the massaging member slightly tilted backwardly from the vertical (in the first position corresponding to user's calf).
Figure 3:
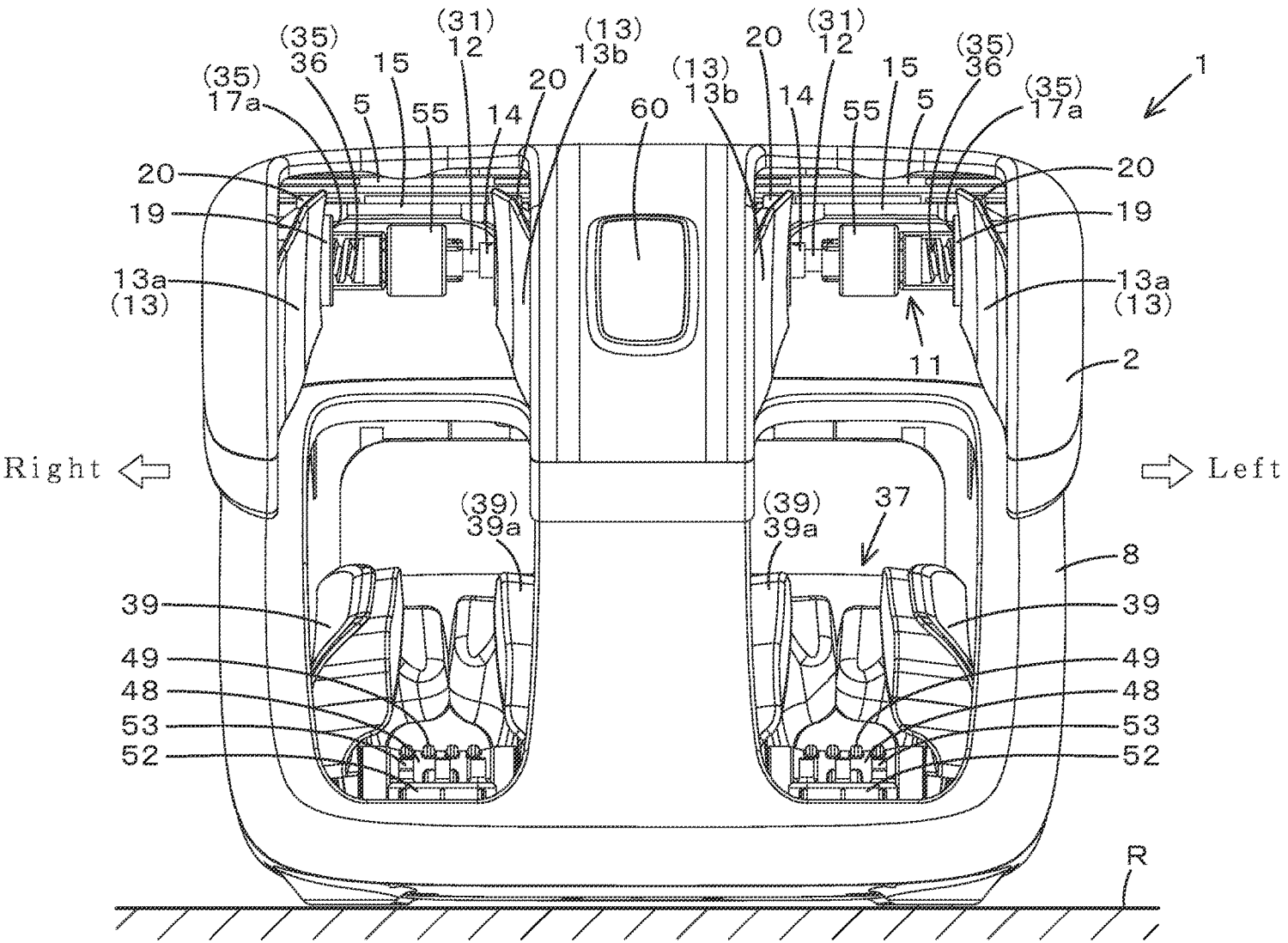
FIG. 3 is a front view showing the leg massager embodying the present invention.

In the "first position" shown in the drawings such as FIGS. 1 and 7, the first massaging member 13 stays with its front end bent downwardly for massaging operation for the calf 1 (first massage target area). In the "second position" shown in FIG. 8, the first massaging member 13 stays with its front end facing frontward for massaging operation for the calf 1, the side of the knee. etc. In the "third position" shown in the drawings such as FIGS. 5 and 9, the first massaging member 13 stays with its front end bent forwardly for massaging operation for the thigh T (second massage target area).

The first rotation shaft 12, which is oriented with its axis extending in the horizontal direction, is mounted so as to pass through the base end of the first massaging member 13 (first conversion section 14) in the horizontal direction. The first rotation shaft 12 is supported by the first gear box 28 constituting the driving mechanism 23 and a pair of shaft supporting portions 16.

The first conversion section 14 comprises: a first inclined boss portion 17 that rotates unitarily with the first rotation shaft 12; a first annular fit portion 19 situated at the base end of the first massaging member 13, and fitted onto the first inclined boss portion 17 for free relative rotation; and a first restraint portion 20 that restrains the first massaging member 13 from rotating in accompanying relation with the rotation of the first rotation shaft 12.

The first inclined boss portion 17 has formed at its outer periphery a cam face 18 inclined with respect to the first rotation shaft 12. Thus, the first inclined boss portion 17 rotates in inclined relation to the axis of the first rotation shaft 12. The first inclined boss portion 17 (cam face 18) corresponding to the right-hand first massaging member 13 and the first inclined boss portion 17 (cam face 18) corresponding to the left-hand first massaging member 13 are inclined in opposite directions. The first massaging member 13 undergoes rocking motion in response to the inclined rotation of the first inclined boss portion 17 externally fitted with the first annular fit portion 19.

The first restraint portion 20 comprises: a first restraint pin 21 attached to the first annular fit portion 19 so as to be located toward the base end of the first annular fit portion 19; and a first restraint slot 22, provided in the base 15, for slidably receiving the first restraint pin 21. The first restraint pin 21 is installed so as to protrude from the first annular fit portion 19 in the opposite direction to the first massaging member 13. That part of the base 15 opposed to the first restraint pin 21 is formed with the horizontally elongated first restraint slot 22. The first restraint pin 21 is slidably received in the first restraint slot 22 for side-to-side rocking motion in substantially the horizontal direction. This arrangement restrains the first annular fit portion 19 from rotating in accompanying relation with the rotation of the first inclined boss portion 17.

Thus, a pair of the first massaging members 13 is provided for each of the right-hand and left-hand first massaging recesses 7 of the upper casing 2, or equivalently two pairs of the first massaging members 13 are provided in total. The right-hand and left-hand first massaging members 13 in each pair are moved close to and away from each other, and the resulting rocking motion produces effective squeezing massage for the calf C or the thigh T.

The driving mechanism 23, which is mounted within the lower casing 8, drives the first rotation shaft 12 of the upper massaging system 11 and a second rotation shaft 38 of the lower massaging system 37 (to be hereafter described in detail) to rotate together for actuation of each massaging system to produce squeezing massage.

Figure 4:
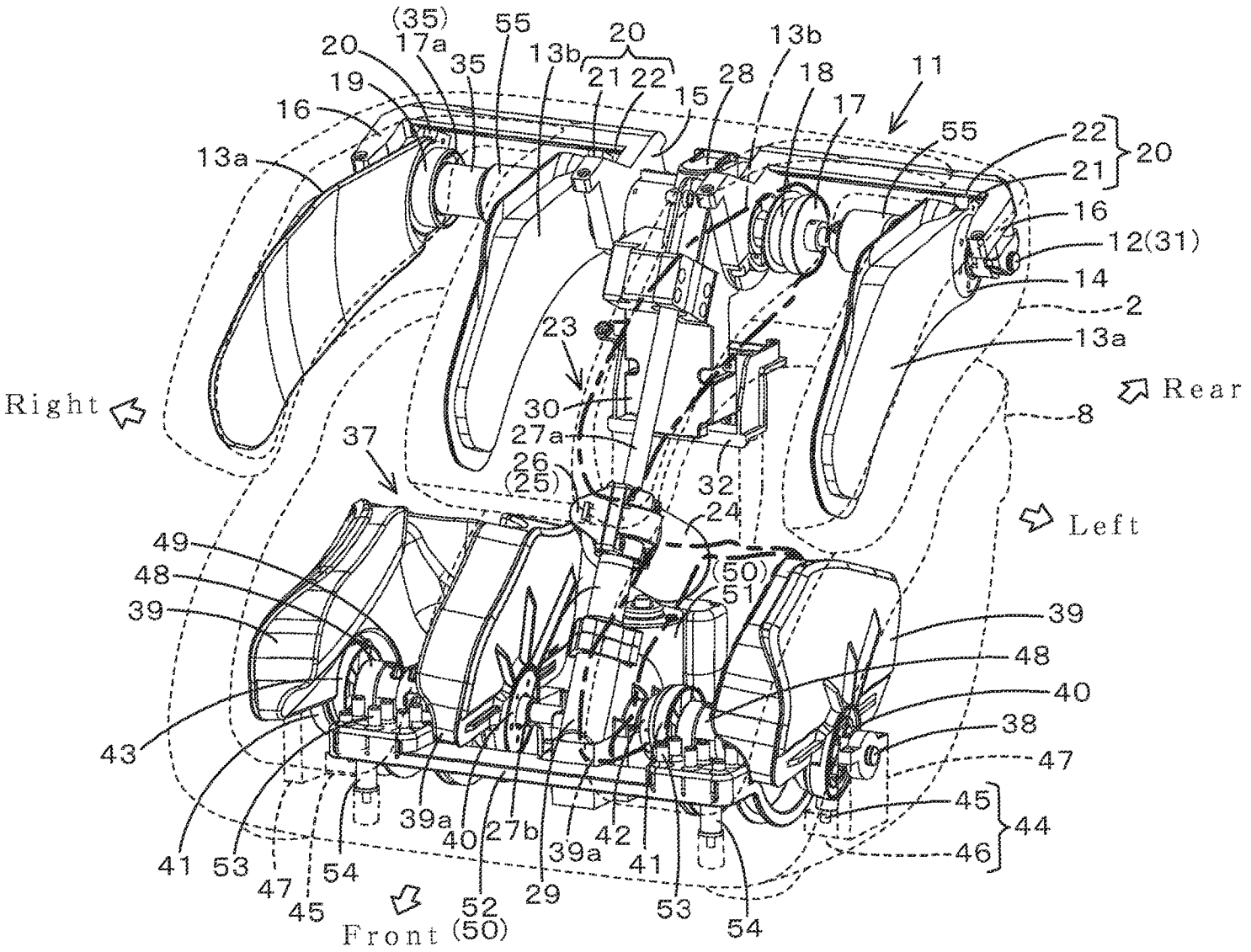
FIG. 4 is a front perspective view showing the internal structure of the leg massager embodying the present invention.
Figure 5:
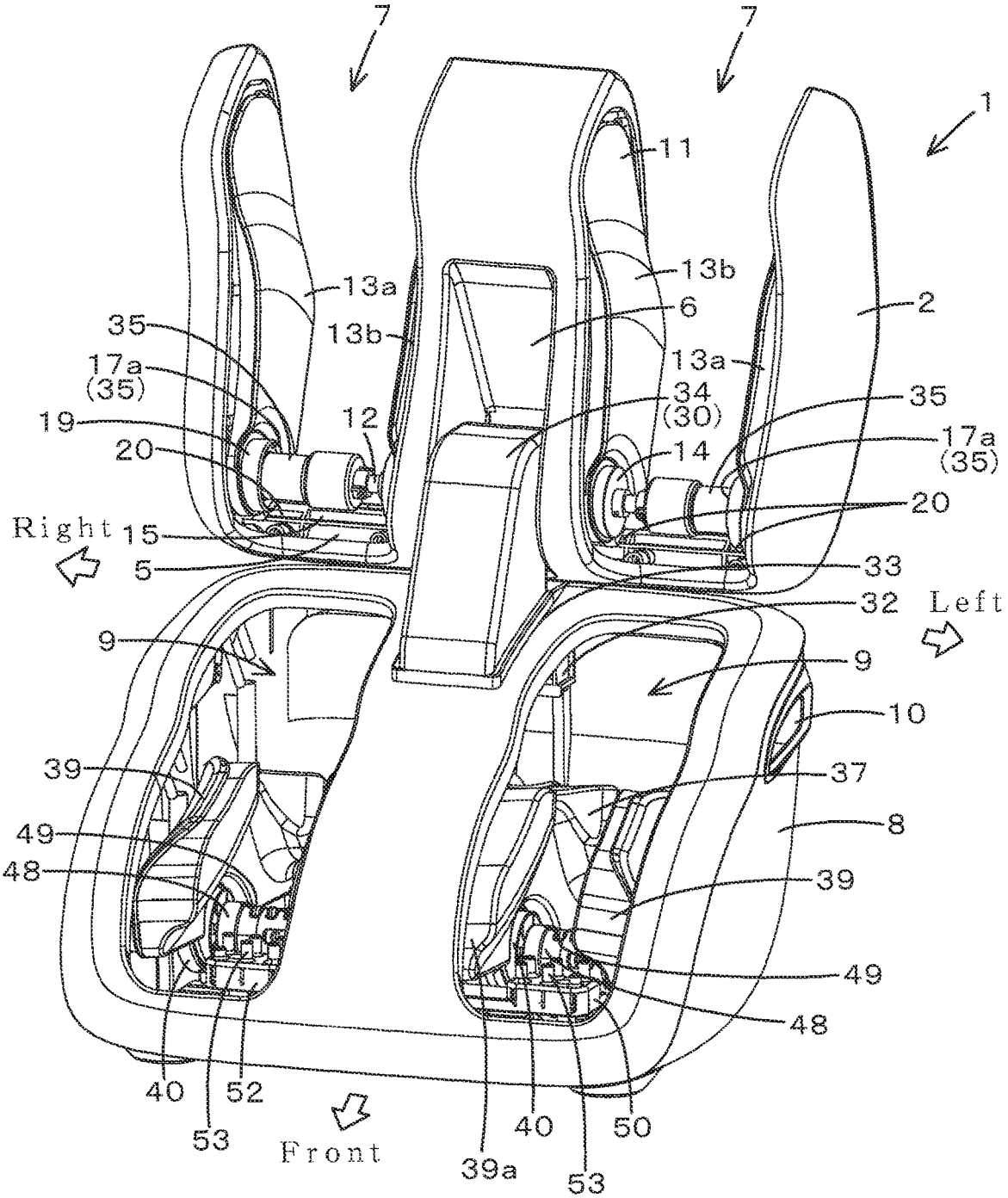
FIG. 5 is a front perspective view showing the structure of the leg massager embodying the present invention, with the massaging member of the upper massaging system oriented substantially vertically (in the second position corresponding to user's thigh).

As shown in FIG. 4, the driving mechanism 23 comprises: a driving motor 24 that produces output of a rotatably driving force; an upper transmission shaft 27*a* that inputs the rotatably driving force outputted from the driving motor 24 to the upper massaging system 11; a lower transmission shaft 27*b* that inputs the rotatably driving force outputted from the driving motor 24 to the lower massaging system 37; a first gear box 28 that transmits the received rotatably driving force to the first rotation shaft 12; and a second gear box 29 that transmits the received rotatably driving force to the second rotation shaft 38.

The upper massaging system 11 is driven under the rotatably driving force transmitted thereto through the upper transmission shaft 27*a*, and simultaneously the lower massaging system 37 is driven under the rotatably driving force transmitted thereto through the lower transmission shaft 27*b*.

The driving motor 24 is mounted within the lower casing 8 intermediately of the interior thereof in the vertical direction so as to lie between a left-hand inward second massaging member 39 and a right-hand inward second massaging member 39 that constitute the lower massaging system 37. Moreover, the driving motor 24 is situated between the upper transmission shaft 27*a* and the lower transmission shaft 27*b*.

The driving motor 24 has a forwardly protruding output shaft 25. Thus, the driving motor 24 would be located substantially centrally of the interior of the lower casing 8 both in the vertical direction and in the horizontal direction.

A reduction gear box 26 is disposed forward of the driving motor 24, and, the output shaft 25 is received in the reduction gear box 26.

The upper transmission shaft 27*a* has an upwardly-pointing axis, and is mounted with its upper end facing obliquely rearward. Moreover, the lower transmission shaft 27*b* has a downwardly-pointing axis, and is mounted with its upper end facing obliquely frontward.

Given that the upper transmission shaft 27*a* and the lower transmission shaft 27*b* are integral to form a single shaft body, then the shaft body is disposed so as to span the lower casing 8 and the upper casing 2 in the vertical direction while being supported by the first gear box 28 and the second gear box 29.

The reduction gear box 26 is situated between the upper transmission shaft 27*a* and the lower transmission shaft 27*b*, and, the upper transmission shaft 27*a* and the lower transmission shaft 27*b* are received in the reduction gear box 26.

That is, the driving motor 24 produces output of a rotatably driving force, and, with a reduction in rpm to a predetermined level effected by the reduction gear box 26, the rotatably driving force is inputted via the upper transmission shaft 27*a* to the first gear box 28 above, and then transmitted to the first rotation shaft 12, and is also inputted via the lower transmission shaft 27*b* to the second gear box 29 below, and then transmitted to the second rotation shaft 38. This allows concurrent actuation of the upper massaging system 11 and the lower massaging system 37.

The first gear box 28 is disposed between the inward first massaging members 13*b* constituting the upper massaging system 11. The first gear box 28 is supported by the rockably supporting portion 30, and receives therein the upper end of the upper transmission shaft 27*a*. The first gear box 28 is so designed that the horizontally oriented first rotation shaft 12 mounted within the upper casing 2 passes therethrough. Upon the inputting of the rotatably driving force to the first gear box 28 through the upper transmission shaft 27*a*, the piercingly mounted first rotation shaft 12 is rotated.

The second gear box 29 is disposed between the inward second massaging members 39*a* constituting the lower massaging system 37 to be hereafter described in detail. The second gear box 29 receives therein the lower end of the lower transmission shaft 27*b*. The second gear box 29 is so designed that the horizontally oriented, lower massaging system 37-constituting second rotation shaft 38 mounted within the lower casing 8 passes therethrough. Upon the inputting of the rotatably driving force to the second gear box 29 through the lower transmission shaft 27*b*, the piercingly mounted second rotation shaft 38 is rotated. Predetermined worm gear and worm wheel are housed within each of the gear boxes 26, 28, and 29.

Thus, in the leg massager 1 of the present invention, the rotatably driving force outputted from the driving motor 24 of the driving mechanism 23 is distributed between the upper transmission shaft 27*a* and the lower transmission shaft 27*b* to allow both of the upper massaging system 11 and the lower massaging system 37 to receive input of the rotatably driving force. That is, in the leg massager 1 of the present invention, the upper massaging system 11 and the lower massaging system 37 are driven by one common driving motor 24. In the alternative, the upper massaging system 11 and the lower massaging system 37 may be driven by their respective driving motors 24.

As shown in the drawings such as FIGS. 1 to 9, the leg massager 1 of the present invention is so designed that the upper massaging system 11 is supported for rocking motion about its horizontal axis by the rockably supporting portion 30. The following describes the details of the rockably supporting portion 30.

Figure 6:
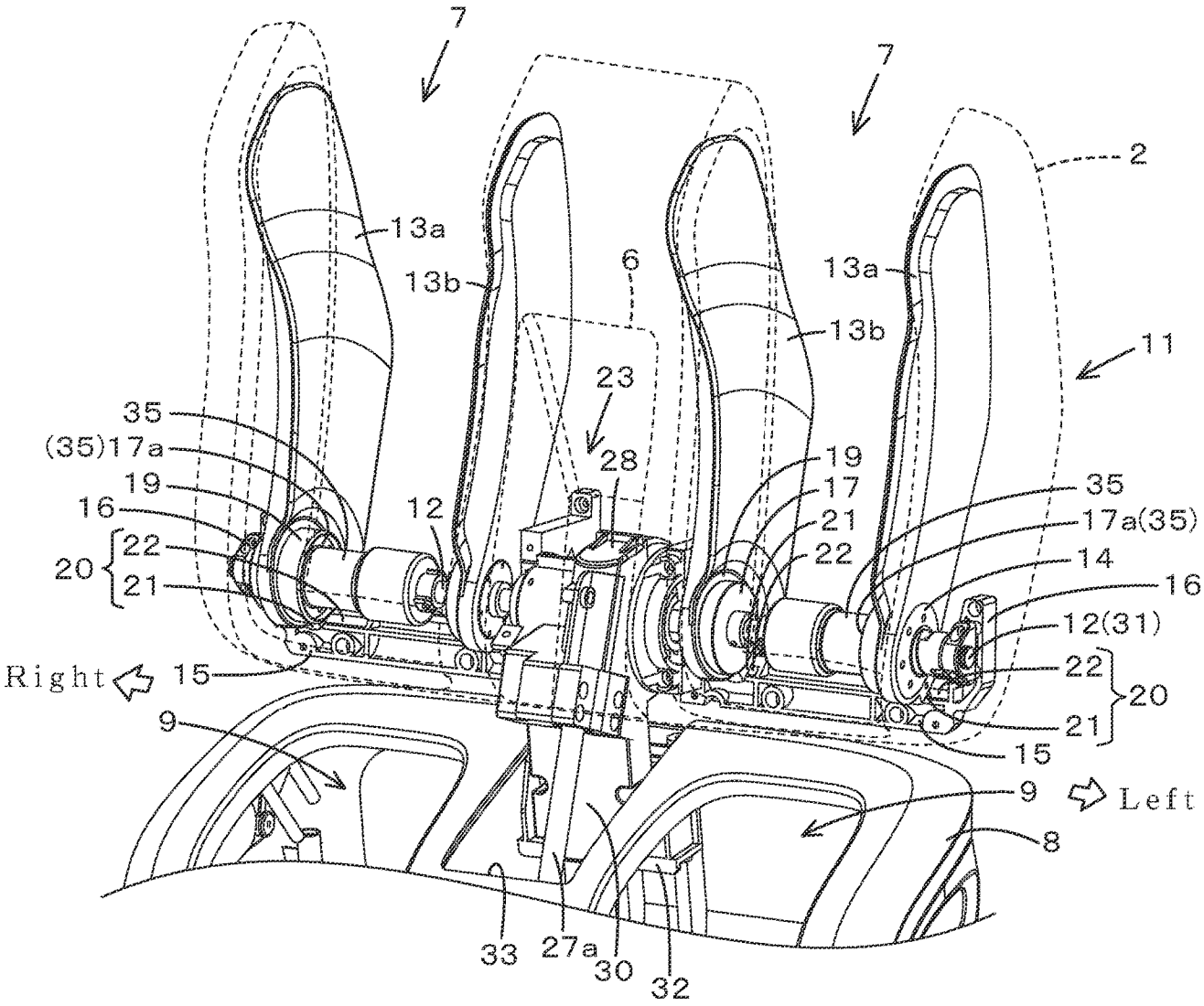
FIG. 6 is a front perspective view showing the internal structure of the substantially vertically oriented massaging member of the upper massaging system (rockably supporting portion).

As shown in the drawings such as FIGS. 4 and 6, the rockably supporting portion 30, which is located toward the top of the lower casing 8, supports the base end of the upper casing 2 (corresponding to a midportion of the upper massaging system 11) for free rocking motion to impart rising movement to the front end of the upper casing 2 via a horizontally oriented rock shaft 31. In this embodiment, the rock shaft 31 is implemented by using the shaft member constituting the first rotation shaft 12. That is, a lengthwise midportion of the first rotation shaft 12 serves as the rock shaft 31.

The rockably supporting portion 30 is an upstanding support member mounted so as to extend upwardly from the holder portion 32 located centrally of the upper part of the lower casing 8 interiorly thereof. The rockably supporting portion 30 mounted so as to extend upwardly from the holder portion 32 within the lower casing 8 supports the first gear box 28 constituting the driving mechanism 23 from below.

The holder portion 32 is amounting member located centrally of the upper part of the inner rear face of the lower casing 8 interiorly thereof. The holder portion 32 supports the rockably supporting portion 30 disposed on it from below. That part of the upper face of the lower casing 8 located above the holder portion 32 is formed with an opening 33. The rockably supporting portion 30 attached to the holder portion 32 is mounted so as to protrude upwardly while passing through the opening 33. In the opening 33, there is provided the cap body 34 which covers the rockably supporting portion 30, the first gear box 28, etc.

That is, the rockably supporting portion 30 is mounted via the holder portion 32 so as to protrude from the opening 33 formed in the top part of the lower casing 8. The rockably supporting portion 30 supports the first gear box 28 from below, and supports the lengthwise midportion of the first rotation shaft 12 (serving as the rock shaft 31) for free rotation about its horizontal axis via a bearing provided in the first gearbox 28. Thus constructed, the rockably supporting portion 30 supports the upper massaging system 11 for free rocking motion.

The upper massaging system 11 is mounted in suspended fashion above the lower casing 8 while being supported at one point by the rockably supporting portion 30 located centrally of the upper part of the lower casing 8 interiorly thereof.

In this embodiment, when the upper casing 2 supported by the rockably supporting portion 30 is tilted forwardly to adjacent the lower casing 8, then the first massaging member 13 housed within the upper casing 2 faces frontward, and, when the upper casing 2 is raised away from the lower casing 8, then the first massaging member 13 housed within the upper casing 2 faces upward.

Thus, in this embodiment, the first massaging member 13 is made position-switchable to assume a plurality of positions ranging from the "first position" shown in FIG. 7 (where the first massaging member 13 faces frontward obliquely downwardly) to the "third position" shown in FIG. 9 (where it faces upward). That is, the position of the first massaging member 13 can be switched among a plurality of levels ranging from the "first position "(where the first massaging member 13 stays substantially horizontal) to the "third position" (where the first massaging member 13 is slightly tilted backwardly from the vertical) for selective massage operation for any of massage target areas including the calf C (first massage target area) and the thigh T (second massage target area).

The rock shaft 31 may be provided independently of the first rotation shaft 12 as a separate second shaft body. In this case, for example, the second shaft body serving as the rock shaft 31 has the form of a horizontally oriented shaft mounted coaxially in parallel with the first rotation shaft 12 within the rockably supporting portion 30. Then, the first gear box 28 and the first rotation shaft 12 are each mounted so as to be supported for free rotation about the horizontal axis of that shaft. This arrangement also allows the upper massaging system 11 to be rockably supported.

The rockably supporting portion 30 may be configured differently from the way as exemplified in the embodiment, it is only necessary that it be capable of supporting the upper massaging system 11 for rocking motion about its horizontal axis. For example, a pair of rockably supporting portions 30 may be provided. In this case, the paired rockably supporting portions 30 are disposed in upwardly-extending condition on the right and left sides, respectively, of the upper part of the lower casing 8 interiorly thereof. That is, each rockably supporting portion 30 rotatably supports corresponding one of the right and left ends of the horizontally oriented first rotation shaft 12 (rock shaft 31), and thus supports corresponding one of the right and left sides of the upper massaging system 11 for free rocking motion.

With consideration given to variations in the size (dimensions) of the leg L (calf C or thigh T) among different users, in this embodiment, the upper massaging system 11 has a pitch adjustment mechanism 35 for adjustment of the distance between the paired first massaging members 13. The pitch adjustment mechanism. 35, which is mounted on the first rotation shaft 12 so as to be located toward the outward first massaging member 13*a*, comprises a threaded screw portion 36 having spiral external teeth, and an outward first inclined boss portion 17*a* having internal teeth that threadedly engage the threaded screw portion 36. Moreover, for example, a button for operating the pitch adjustment mechanism 35 in a manner permitting pitch adjustment in a desired manner, not shown, may be additionally provided in the upper casing 2, for example.

When the user pushes the button provided in, for example, the upper casing 2, then the outward first inclined boss portion 17*a* moves over the threaded screw portion 36 in the horizontal direction, causing the outward first massaging member 13*a* to move in the horizontal direction. In this way, the distance between the paired first massaging members 13 can be adjusted in a desired manner.

With consideration given also to variations in the size (dimensions) of the foot F among different users, the lower massaging system 37 to be hereafter described may be provided with a pitch adjustment mechanism 35.

Moreover, it is preferable that the leg massager has a built-in detection portion, such as a distance sensor or a load sensor, that detects the shape (size) of user's leg L (the calf C, the thigh T, the foot F, etc.), and that the pitch adjustment mechanism 35 effects, in conjunction with the detection portion, adjustment of the distance between the paired first massaging members 13 on the basis of detected results.

Although another mechanism may be adopted for use as the pitch adjustment mechanism 35, the mechanism disclosed in Japanese Unexamined Patent Publication JP-A 2017-153734, or equivalently the described mechanism is most desirable for use.

In this embodiment, the lower massaging system 37 comprises: the horizontally oriented second rotation shaft 38 which rotates under a rotatably driving force from the lower transmission shaft 27*b* constituting the driving mechanism 23; a pair of right-hand and left-hand second massaging members 39 located at an intermediate part of the second rotation shaft 38, the second massaging members 39 being movable close to and away from each other under a rotatably driving force exerted by the second rotation shaft 38 for squeezably holding the foot F including at least a toe-to-heel region; and a second conversion section 40 that converts the rotatably driving force of the second rotation shaft 38 into rocking motion of the paired right-hand and left-hand second massaging members 39.

The second massaging member 39 is located toward the bottom of the lower casing, yet located above the second rotation shaft 38. The second massaging member 39 is a platy member elongated in a front to rear, or front-rear direction, which conforms to the shape of the foot F (including the toe, the instep, the ankle, the heel, etc.) and is bent so as to somewhat overhang the foot F. There is provided a pair of horizontally-spaced-apart second massaging members 39 for the insertion and retention of a massage target area of the foot F in between. The second massaging members 39 perform squeezing (pressing) massage operation for the foot F.

The second rotation shaft 38, which is oriented with its axis extending in the horizontal direction, is supported via a shaft bearing (bearing) by two support members 47 and the second gear box 29 of the driving mechanism 23 located toward the bottom of the lower casing 8. The second rotation shaft 38 is mounted so as to pass through the base end of the second massaging member 39 (second conversion section 40) in the horizontal direction.

The second conversion section 40 comprises: a second inclined boss portion 41 that rotates unitarily with the second rotation shaft 38; a second annular fit portion 43 situated at the base end of the second massaging member 39, and fitted onto the second inclined boss portion 41 for free relative rotation; and a second restraint portion 44 that restrains the second massaging member 39 from rotating in accompanying relation with the rotation of the second rotation shaft 38.

The second inclined boss portion 41 has formed at its outer periphery a cam face 42 inclined with respect to the second rotation shaft 38. Thus, the second inclined boss portion 41 rotates in inclined relation to the axis of the second rotation shaft 38. The second inclined boss portion 41 (cam face 42) corresponding to the right-hand second massaging member 39 and the second inclined boss portion 41 (cam face 42) corresponding to the left-hand second massaging member 39 are inclined in opposite directions. The second massaging member 39 undergoes rocking motion in response to the inclined rotation of the second inclined boss portion 41 externally fitted with the second annular fit portion 43.

The second restraint portion 44 comprises: a second restraint pin 45 attached to the second annular fit portion 43 so as to be located toward the base end of the second annular fit portion 43; and a second restraint slot 46, formed at the surface of the inner bottom of the lower casing 8, for slidably receiving the second restraint pin 45.

The second restraint pin 45 is installed so as to protrude from the second annular fit portion 43 in the opposite direction to the second massaging member 39. That part of the lower casing 8 opposed to the second restraint pin 45 is formed with the horizontally elongated second restraint slot 46. The second restraint pin 45 is slidably received in the second restraint slot 46 for side-to-side rocking motion in substantially the horizontal direction. This arrangement restrains the second annular fit portion 43 from rotating in accompanying relation with the rotation of the second inclined boss portion 41.

The lower massaging system 37 further comprises a sole massaging roller 48 that performs pressing massage operation for the lengthwise midportion of the sole S (the arch (of the foot) A).

The sole massaging roller 48 is interposed between the paired right-hand and left-hand second massaging members 39. The sole massaging roller 48 in the form of a rotatable cylindrical member having a horizontal axis is mounted so as to pass through the second rotation shaft 38 in impaled fashion.

The outer periphery of the sole massaging roller 48 is provided with a plurality of radially-outwardly extending massaging pieces 49 spaced apart in a direction circumferentially of the sole massaging roller 48, as well as in a direction axially of the second rotation shaft 38.

Given that the paired second massaging members 39 and the sole massaging roller 48 are grouped in a set, then the set is provided for each of the right-hand and left-hand second massaging recesses 9 of the lower casing 8, or equivalently two sets are provided in total.

The paired right-hand and left-hand second massaging members 39 are moved close to and away from each other, and the resulting rocking motion produces effective squeezing massage for the foot F, or equivalently the toe-to-heel region. Moreover, under the rotational movement of the sole massaging roller 48, the massaging pieces 49 act to perform effective pressing massage on the arch A of the sole S.

In addition, a vibratory massaging system 50 is incorporated in the leg massager 1 according to the embodiment. The vibratory massaging system 50 comprises: a motor 51 that produces a rotatably driving force; a vibration producing section, not shown, that converts the rotatably driving force into vibration; and a sole massaging member 52 which is vibrated by the vibration producing section.

The sole massaging member 52 is shaped in a rectangular frame on which is mounted the second rotation shaft 38 fitted with the sole massaging roller 48. The sole massaging member 52 has a plurality of massaging pieces 53 in projection form, of which some are located toward the front in corresponding relation to the front side of the sole S, and others are located toward the rear in corresponding relation to the rear side of the sole S, with the sole massaging roller 48 lying in between in the front-rear direction. The underside of the sole massaging member 52 is provided with a vibrating element 54 made of an elastic body such as rubber. The vibrating element 54 is disposed at least at each of the four corners of the frame constituting the sole massaging member 52. The vibrating element 54 is attached to the bottom of the lower casing 8.

The motor 51 has a downwardly-facing output shaft with an eccentric cam, not shown, attached to its front end. The eccentric cam is fitted in a recess, not shown, formed in the sole massaging member 52. That is, the vibration producing section comprises the eccentric cam attached to the output shaft of the motor 51 and the recess of the sole massaging member 52.

The sole massaging member 52 is contacted at its recess by the now rotating eccentric cam, causing vibration of the sole massaging member 52. At the same time, the vibrating element 54 also vibrates, which results in the sole massaging member 52 being vibrated to a larger extent. This allows the massaging pieces 53 of the now vibrating sole massaging member 52 to perform vibratory massage on the front and rear sides of the sole S.

The following describes the conditions of the first massaging member 13 set in different positions, namely the first to third positions, with reference to FIGS. 7 to 9.

For example, in the "first position" shown in FIG. 7, the first massaging member 13 is set at such a position as to stay substantially horizontal and protrude forwardly. In the first position, the first massaging recess 7 opens into the upward surface, the forward surface, and the downward surface of the upper casing 2, and, the cap body 34 which covers the rockably supporting portion 30 is received in the cavity 6 formed in the lower cover body 3.

The user inserts the calf C and the foot F into the first massaging recess 7 and the second massaging recess 9, respectively, of the leg massager 1.

In the "first position", the first massaging members 13 effect pressing massage operation by applying external pressure to the calf C (first massage target area) received in the first massaging recess 7 in a squeezing manner. At this time, the upper massaging system 11 is held in place by the calf C-squeezing action.

More specifically, as shown in FIG. 7, each first massaging member 13 stays with its lengthwise midportion covering the front part of the calf C sideways, and with its base end covering the rear part of the calf C sideways, to effect pressing massage operation for the entire calf C by applying pressure to both outward and inward areas (front and rear parts) of the calf C in a squeezing manner. Note that the lengthwise pressing range of the first massaging member 13 varies depending on the size of user's calf C.

Moreover, in the "first position", the second massaging members 39 effect pressing massage operation by applying external pressure to the foot F (second massage target area) received in the second massaging recess 9 in a squeezing manner.

More specifically, as shown in FIG. 7, each second massaging member 39 stays with its forward end covering the toe sideways, and with its base end covering the heel sideways, to effect pressing massage operation for the foot F (toe-to-heel region) by applying pressure to both outward and inward areas of the foot F in a squeezing manner.

The massaging position can be changed to the "second position" by lifting the upper casing 2 with user's hand grasping the side of the front end of the upper casing 2 under a predetermined force to cause the upper massaging system 11 to rotate about the axis of the first rotation shaft 12 (rock shaft 31).

In the "second position" shown in FIG. 8, the first massaging member 13 is set at such a position as to remain slightly upward and face frontward obliquely upwardly.

In the "second position", for example, the first massaging members 13 effect pressing massage operation by applying external pressure to the calf C around its upper part and the side of its below-knee part received in the first massaging recess 7 in a squeezing manner. At this time, the upper massaging system 11 is held in place by the action of squeezably holding the range from the upper part of the calf C to below the knee.

More specifically, as shown in FIG. 8, each first massaging member 13 stays with its lengthwise midportion covering the calf C around its upper part and below-knee part sideways to effect pressing massage operation by applying pressure to both outward and inward areas of the upper part, etc. of the calf C in a squeezing manner. The second position shown in FIG. 8 may be construed as a position in transition from the first position to the third position.

The massaging position can be changed to the "third position" by lifting the upper casing 2 further with user's hand grasping the side of the front end of the upper casing 2 under a predetermined force to cause the upper massaging system 11 to rotate about the axis of the first rotation shaft 12 (rock shaft 31).

In the "third position" shown in FIG. 9, the first massaging member 13 is set at such a position as to lean backward and face obliquely upward. In the third position, the first massaging recess 7 opens into the upward surface, the forward surface, and the rearward surface of the upper casing 2.

In the "third position", the first massaging members 13 effect pressing massage operation by applying external pressure to the thigh T (first massage target area) received in the first massaging recess 7 in a squeezing manner. At this time, the upper massaging system 11 is held in place by the thigh T-squeezing action.

More specifically, as shown in FIG. 9, each first massaging member 13 stays with its upper end covering the upper part of the thigh T sideways, and with its lengthwise midportion covering the lateral part of the thigh T sideways, to effect pressing massage operation for the entire thigh T by applying pressure to both outward and inward areas of the thigh T in a squeezing manner.

To change (return) the massaging position to the "first position" or the "second position", the described operation is reversed in sequence. Note that the massaging positions ranging from the "first position" to the "third position" are suggested by way of example and not intended to be limiting of the angle of inclination of the upper massaging system 11 as illustrated herein.

As thus far described, according to the present invention, the upper massaging system 11 is supported by the rockably supporting portion 30 so as to be rockable about its horizontal axis to allow selection among predetermined massaging positions in the front-rear direction (the first to third positions). That is, the position of the first massaging member is adjustable. This allows the upper massaging system 11 to perform pressing massage selectively on any of massaging target areas, including the calf C and the thigh T, of the leg L of the user sitting in a chair, for example. At the same time, the lower massaging system 37 can be operated to perform pressing massage on the foot F.

It should be understood that the embodiment as disclosed herein is considered in all respects as illustrative only and not restrictive.

In particular, as such design requirements as not explicitly specified in the disclosure of the embodiment, for example, working and operating conditions, the dimensions and weights of constituent components, etc., use has been made of general requirements adopted in the light of the common knowledge of those skilled in the art without a departure from practical ranges.

For example, the leg massager 1 of the present invention may be provided with an air blower pump and a heater that warms air from the air blower pump. That is, the leg massager 1 may be so designed that the neighborhood of the first massaging members 13 and the second massaging members 39 can be warmed by internally blowing air warmed by the heater to achieve thermal massage for a massage target area such as the foot F, the calf C, and the thigh T.

Moreover, the leg massager 1 of the present invention may be provided with an air-bag member that performs pressing massage on a massage target area of user's body. A pair of air-bag members may be mounted in the location where a pair of the first massaging members 13 is disposed, as well as in the location where a pair of the second massaging members 39 is disposed.

Moreover, the leg massager 1 of the present invention may be provided with a positioning mechanism capable of stopping the rocking motion of the upper massaging system 11. That is, the positioning mechanism may be designed to effect engagement of the upper massaging system 11 therewith in a predetermined position to cause the upper massaging system 11 to stop its rocking motion in a predetermined position in the front-rear direction (massaging position).

For example, a single positioning mechanism may be disposed in the vicinity of the rockably supporting portion 30, that is; located centrally of the upper massaging system 11. Moreover, as the positioning mechanism, for example, use can be made of a ratchet mechanism capable of a step-by-step positional adjustment.

A cylindrical member 55 is attached to that part of the first rotation shaft 12 located between the paired right-hand and left-hand first massaging members 13. The outer periphery of the cylindrical member 55 may be provided with a projection which is pressed against a massage target area such as the calf C or the backside of the thigh T. In this case, the cylindrical member 55 serves as a rotative massaging member.

Moreover, the material used to form the described upper and lower casings 2 and 8 is not limited to a specific material. The upper and lower casings 2 and 8 may be made of either a hard material such as plastic or a soft material such as cloth.

Moreover, for example, the leg massager 1 may be so designed that the intensity or rhythm of massage to be performed on the leg L is adjustable. In addition, any one or both of the upper massaging system 11 and the lower massaging system 37 may be designed to detect the size of user's leg and operate the pitch adjustment mechanism 35 in a manner permitting adjustment of the distance between paired massaging members (the first massaging members 13, the second massaging members 39) on the basis of the result of detection. As the pitch adjustment mechanism 35, the mechanism disclosed in Japanese Unexamined Patent Publication JP-A 2017-153734 is most desirable for use. A mechanism for adjustment of the rocking angle of a pair of massaging members (the first massaging members 13, the second massaging members 39) may be additionally provided.

The present invention imposes no special limitations upon the basic structural design of the upper massaging system 11 and the lower massaging system 37. That is, various systems may suitably be adopted for use as the upper massaging system 11 and the lower massaging system 37.

REFERENCE SIGNS LIST

1 Leg massager
2 Upper casing
3 Lower cover body
4 Upper cover body
5 Mounting portion
6 Cavity
7 First massaging recess
8 Lower casing
9 Second massaging recess
10 Hand well
11 Upper massaging system
12 First rotation shaft
13 First massaging member
**13*a*** Outward first massaging member
**13*b*** Inward first massaging member
14 First conversion section
15 Base
16 Shaft supporting portion
17 First inclined boss portion
**17*a*** Outward first inclined boss portion
18 Cam face
19 First annular fit portion
20 First restraint portion
21 First restraint pin
22 First restraint slot
23 Driving mechanism
24 Driving motor
25 Output shaft
26 Reduction gear box
**27*a*** Upper transmission shaft
**27*b*** Lower transmission shaft
28 First gear box
29 Second gear box
30 Rockably supporting portion
31 Rock shaft
32 Holder portion
33 Opening
34 Cap body
35 Pitch adjustment mechanism
36 Threaded screw portion
37 Lower massaging system
38 Second rotation shaft
39 Second massaging member
**39*a*** Inward second massaging member
40 Second conversion section
41 Second inclined boss portion
42 Cam face
43 Second annular fit portion
45 Second restraint pin
46 Second restraint slot
47 Support member
48 Sole massaging roller
49 Massaging piece
50 Vibratory massaging system
51 Motor
52 Sole massaging member
53 Massaging piece
54 Vibrating element
55 Cylindrical member
60 Switch
L Leg
F Foot
C Calf
T Thigh
S Sole
A Arch (of the foot)
R Floor

The invention claimed is:

1. A leg massager comprising:

a lower massaging system that massages a massage target area of user's leg including at least user's foot;

an upper massaging system that massages an upper massage target area located above the massage target area which is massaged by the lower massaging system;

a driving mechanism that drives the upper massaging system and the lower massaging system; and a rockably supporting portion that supports the upper massaging system for rocking motion about a horizontal axis, wherein the upper massaging system is mounted within an elongated upper casing, and the lower massaging system is mounted within a lower casing, wherein the rockably supporting portion, which is located toward a top of the lower casing, supports a base end of the upper casing for free rocking motion to impart rising movement to a front end of the upper casing via a horizontally oriented rock shaft, wherein the upper massaging system has a first massaging member in elongated plate form that performs massage operation for the massage target area, and wherein, when the upper casing is tilted forwardly to adjacent the lower casing, then the first massaging member housed within the upper casing faces frontward, and, when the upper casing is raised away from the lower casing, then the first massaging member housed within the upper casing faces upward.

2. The leg massager according to claim 1, wherein the driving mechanism drives the upper massaging system and the lower massaging system together.

3. The leg massager according to claim 2, wherein the driving mechanism comprises: a driving motor that produces output of a rotatably driving force; an upper transmission shaft that inputs the rotatably driving force outputted from the driving motor to the upper massaging system; and a lower transmission shaft that inputs the rotatably driving force to the lower massaging system, and wherein the upper massaging system is driven under the rotatably driving force transmitted thereto through the upper transmission shaft, and the lower massaging system is driven under the rotatably driving force transmitted thereto through the lower transmission shaft.

4. The leg massager according to claim 3, wherein the upper massaging system comprises: a horizontally oriented first rotation shaft which rotates under a rotatably driving force from the upper transmission shaft; a pair of right-hand and left-hand first massaging members located at an intermediate part of the first rotation shaft, the paired first massaging members being movable close to and away from each other under a rotatably driving force exerted by the first rotation shaft for squeezably holding the upper massage target area; and a first conversion section that converts the rotatably driving force of the first rotation shaft into mutually approaching and separating movement of the paired right-hand and left-hand first massaging members.

5. The leg massager according to claim 3, wherein the lower massaging system comprises: a horizontally oriented second rotation shaft which rotates under a rotatably driving force from the lower transmission shaft; a pair of right-hand and left-hand second massaging members located at an intermediate part of the second rotation shaft, the paired second massaging members being movable close to and away from each other under a rotatably driving force exerted by the second rotation shaft for squeezably holding the massage target area including at least the foot; and a second conversion section that converts the rotatably driving force of the second rotation shaft into rocking motion of the paired right-hand and left-hand second massaging members.

6. The leg massager according to claim 4, wherein the rock shaft and the first rotation shaft are implemented by using one common shaft member.

7. The leg massager according to claim 1, wherein the upper massaging system has a pitch adjustment mechanism capable of changing a distance between the paired first massaging members by moving at least one of the paired first massaging members in a horizontal direction.

8. The leg massager according to claim 5, wherein the lower massaging system has a pitch adjustment mechanism capable of changing a distance between the paired second massaging members by moving at least one of the paired second massaging members in a horizontal direction.

9. The leg massager according to claim 1, wherein the driving mechanism drives the upper massaging system and the lower massaging system together.

* * * * *